US006715831B1

(12) United States Patent
Tseng

(10) Patent No.: US 6,715,831 B1
(45) Date of Patent: Apr. 6, 2004

(54) SWING HAVING SEAT UNITS WITH TILTABLE BACKRESTS

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/439,981

(22) Filed: May 16, 2003

(51) Int. Cl.[7] ..... A63G 9/00
(52) U.S. Cl. ..... 297/281; 297/320; 297/322
(58) Field of Search ..... 297/273, 277, 297/281, 282, 317, 320, 321, 322

(56) References Cited

U.S. PATENT DOCUMENTS 3,947,069 A * 3/1976 Lusch ..... 297/317
4,660,884 A * 4/1987 Terui et al. ..... 297/317
5,211,444 A * 5/1993 Kjellman ..... 297/375
6,467,842 B1 * 10/2002 Lu ..... 297/316
6,582,018 B2 * 6/2003 Tseng ..... 297/281
6,585,319 B2 * 7/2003 Tseng ..... 297/281

* cited by examiner

*Primary Examiner*—Peter R. Brown
(74) *Attorney, Agent, or Firm*—Ladas & Parry

(57) ABSTRACT

A swing includes two seat units swingably connected to an upright support frame through suspending members. Each seat unit includes a seat frame disposed between inner and outer armrest frames, and a backrest frame pivoted to the seat frame and rear legs of the armrest frames. Inner and outer rod members are secured to the seat frame. An inner screw rod is rotatably mounted on the inner armrest frame, and is operably associated with the inner rod member. An outer screw rod is rotatably mounted on the outer armrest frame, and is associated with the outer rod member in such a manner that tightening of the outer screw rod prevents movement of the seat frame relative to the armrest frames.

3 Claims, 9 Drawing Sheets

SWING HAVING SEAT UNITS WITH TILTABLE BACKRESTS

BACKGROUND OF THE INVENTION

1. Field of the Invention

The present invention relates to a swing, more particularly to a swing having seat units with tiltable backrests.

2. Description of the Related Art

Referring to FIG. 1, a conventional swing 1 generally includes a seat unit 2 and an upright support frame unit 11. The support frame unit 11 has left and right support frames 111 and a transverse rod 112 fixed to top ends of the frames 111. The seat unit 2 includes left and right armrest frames 21 swingably connected to the transverse rod 112 through suspending members 12, front and rear connecting rods 22, 23 connected respectively to lower ends of the left and right armrest frames 21, a seat frame 24 that is disposed between the left and right armrest frames 21 and that is disposed on the front connecting rod 22, a backrest frame 25 pivoted to the seat frame 24 and disposed on the rear connecting rod 23, and a U-shaped leg member 26 pivoted to the backrest frame 25 and adapted to be seated on the rear connecting rod 23 through two bracers 261, as best shown in FIG. 2.

The conventional swing 1 is disadvantageous in that the backrest frame 25 can only be adjusted between vertical and horizontal positions relative to the seat frame 24. Moreover, as the conventional swing is bulky, storage or transport of the same is relatively inconvenient.

SUMMARY OF THE INVENTION

Therefore, the object of this invention is to provide a swing having seat units with tiltable backrests so as to overcome the aforesaid disadvantages of the prior art.

According to the present invention, a swing includes a pair of seat units and an upright support frame. Each of the seat units includes a plurality of front brackets, a plurality of rear brackets, front and rear connecting rods, spaced apart inverted U-shaped inner and outer armrest frames having inner and outer front legs connected detachably to the front connecting rod through the front brackets, and inner and outer rear legs connected detachably to the rear connecting rod through the rear brackets, a seat frame disposed between the inner and outer armrest frames, first and second pivots, and a backrest frame extending upwardly from and pivoted to the seat frame through the first pivot. The inner and outer rear legs are pivoted to the backrest frame through the second pivot that is parallel to and that is disposed at an elevation above the first pivot so as to permit position adjustment of the backrest frame relative to the seat frame and so as to permit adjustment of the seat frame together with the backrest frame relative to the inner and outer armrest frames. Each of the seat units further includes: L-shaped inner and outer rod members disposed below and secured to the seat frame, and disposed respectively adjacent to the inner and outer front legs, each of the inner and outer rod members having an engaging rod section; a supporting member including an inner sleeve sleeved slidably on the engaging rod section of the inner rod member, and an inner screw rod mounted rotatably on the inner front leg and threadedly engaging the inner sleeve so as to support one side of the seat frame on the inner front leg; and a locking unit including an outer sleeve sleeved slidably on the engaging rod section of the outer rod member, an abutting plate disposed between the outer front leg and the outer sleeve, and an outer screw rod mounted rotatably on the outer front leg and threadedly engaging the outer sleeve in such a manner that tightening of the outer screw rod results in engagement between the abutting plate and the engaging rod section of the outer rod member, thereby preventing sliding movement of the engaging rod section of the outer rod member relative to the outer sleeve, which, in turn, prevents movement of the seat frame together with the backrest frame relative to the inner and outer armrest frames, and that loosening of the outer screw rod results in disengagement between the abutting plate and the engaging rod section of the outer rod member, thereby permitting sliding movement of the engaging rod section of the outer rod member relative to the outer sleeve, which, in turn, permits movement of the seat frame together with the backrest frame relative to the inner and outer armrest frames. The support frame has opposite top and bottom ends, and left and right suspending members that have upper ends connected swingably to the top end of the support frame, and lower ends connected swingably and respectively to the outer armrest frames of the seat units.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
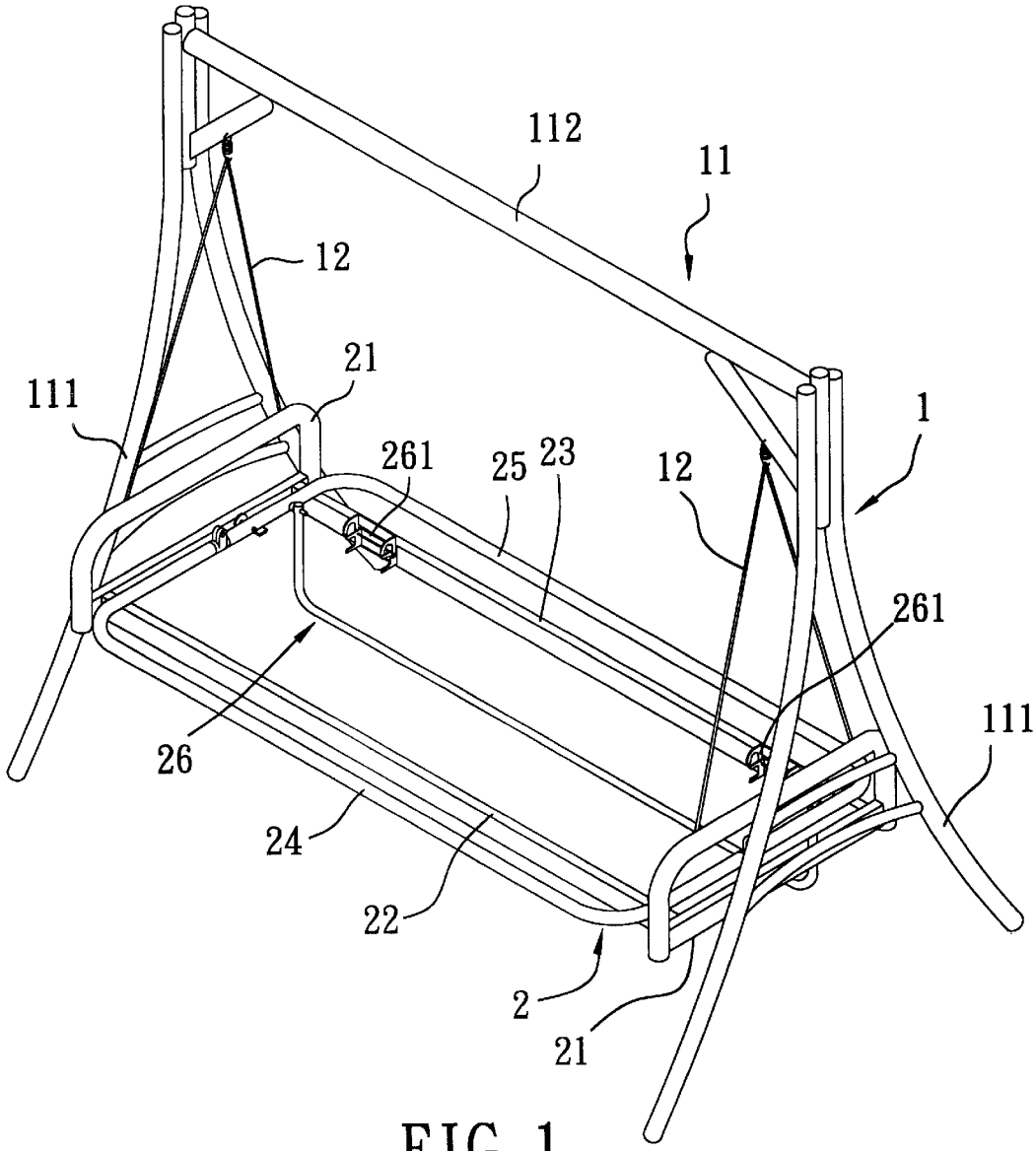
FIG. 1 PRIOR ART
FIG. 1 is a perspective view of a conventional swing.
Figure 2:
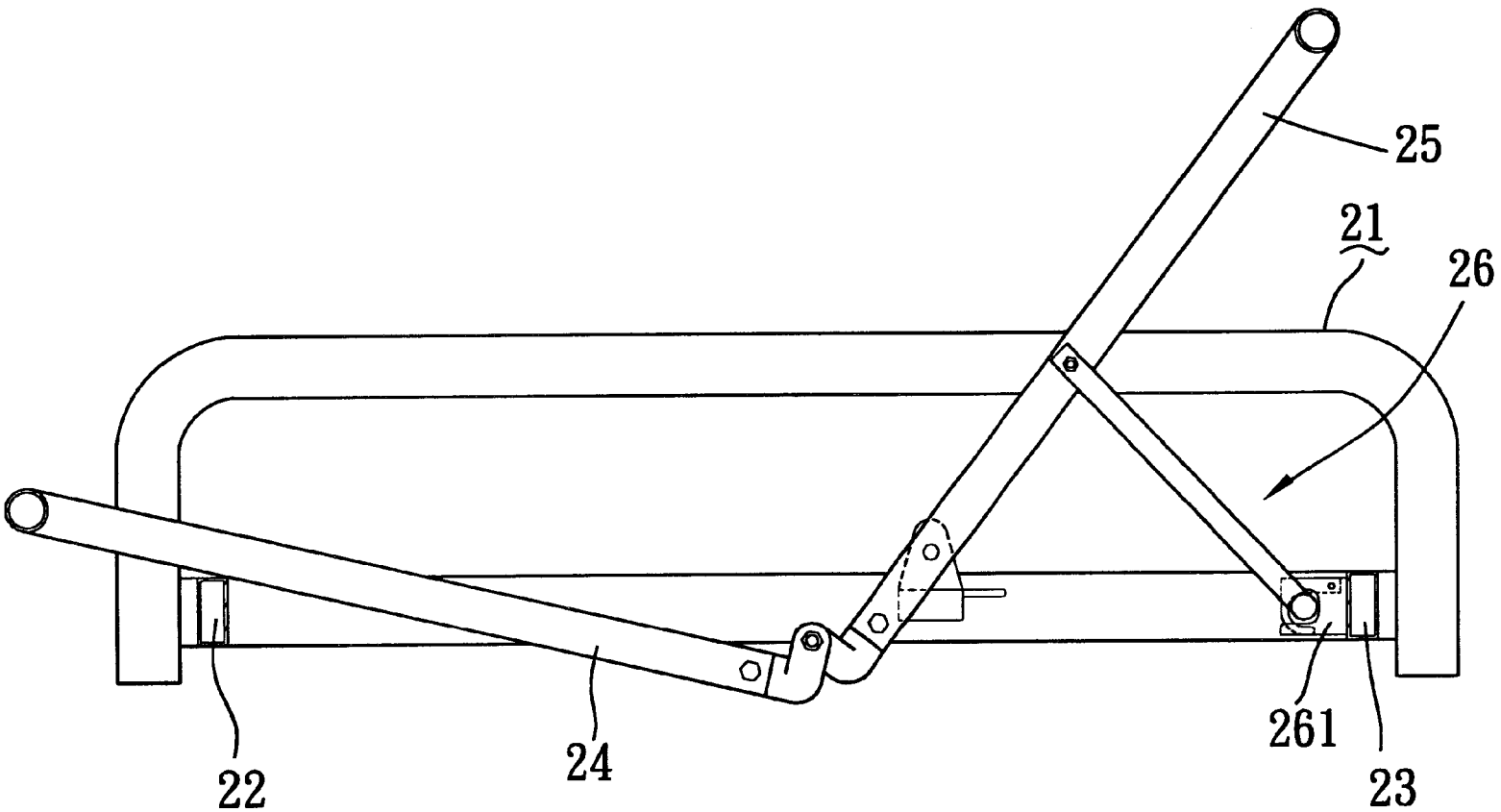
FIG. 2 PRIOR ART
FIG. 2 is a side view of a seat unit employed in the conventional swing.
Figure 3:
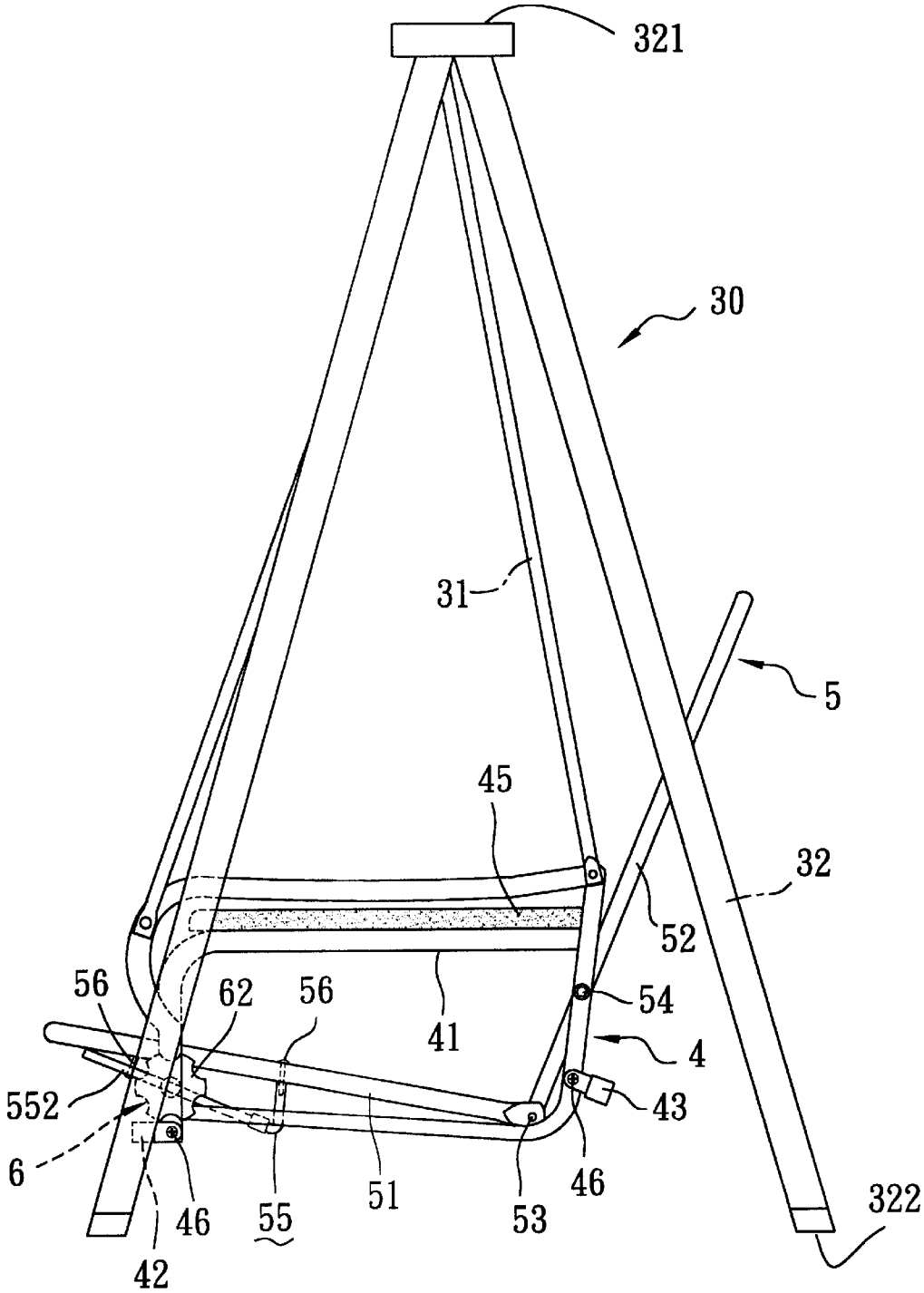
FIG. 3 is a side view of the preferred embodiment of a swing according to the present invention.
Figure 4:
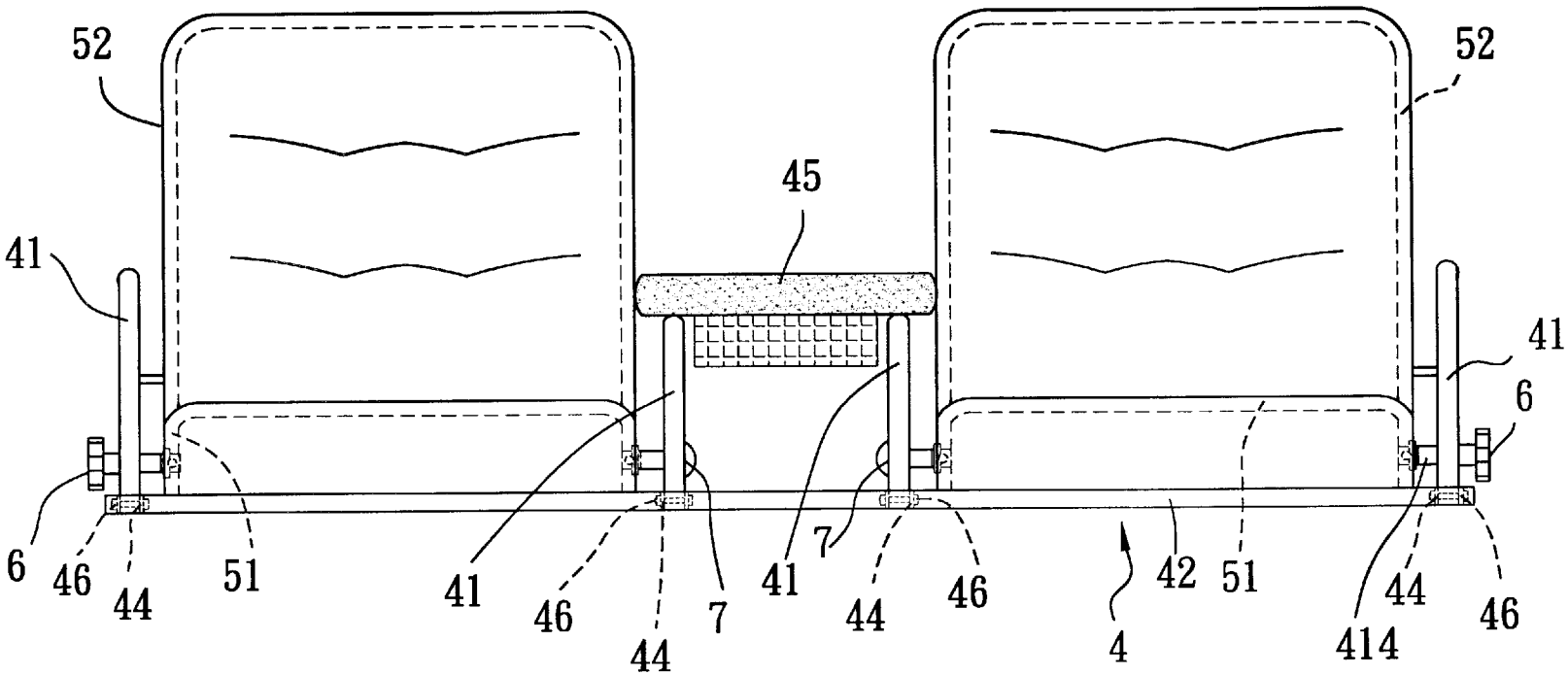
FIG. 4 is a front view of two seat units of the preferred embodiment.
Figure 5:
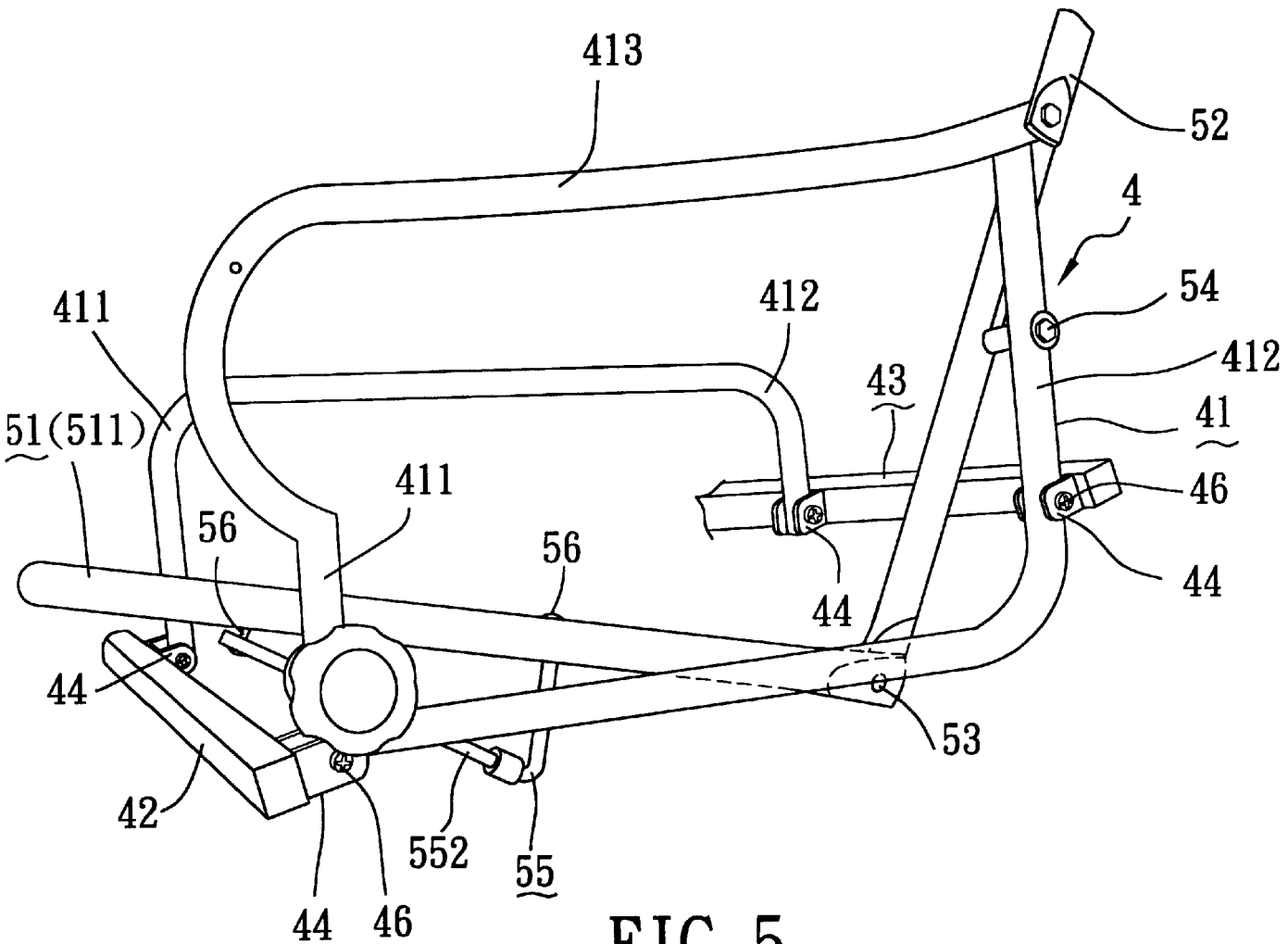
FIG. 5 is a fragmentary perspective view of the seat units of the preferred embodiment.

Referring to FIGS. 3 to 5, the preferred embodiment of a swing 30 according to the present invention is shown to include a pair of seat units 4 and an upright support frame 32.

As illustrated, each of the seat units 4 includes a plurality of front brackets 46, a plurality of rear brackets 46, front and rear connecting rods 42, 43, spaced apart inverted U-shaped inner and outer armrest frames 41, a seat frame 51, first and second pivots 53, 54, a backrest frame 52, L-shaped inner and outer rod members 55, a supporting member 7 and a locking unit 6.

The inner and outer armrest frames 41 respectively have inner and outer front legs 411 connected detachably to the front connecting rod 42 through the front brackets 46, and inner and outer rear legs 412 connected detachably to the rear connecting rod 43 through the rear brackets 46.

The seat frame 51 is disposed between the inner and outer armrest frames 41 of each seat unit 4. The backrest frame 52 extends upwardly from and is pivoted to the seat frame 51 through the first pivot 53. The backrest frame 52 is further pivoted to the inner and outer rear legs 412 through the second pivot 54 that is parallel to and that is disposed at an elevation above the first pivot 53 so as to permit position adjustment of the backrest frame 52 relative to the seat frame 51 and so as to permit adjustment of the seat frame 51 together with the backrest frame 52 relative to the inner and outer armrest frames 41.

The inner and outer rod members 55 are disposed below and secured to the seat frame 51 through screw means 56, and are disposed respectively adjacent to the inner and outer front legs 411. Each of the inner and outer rod members 55 has an engaging rod section 552.

Figure 7:
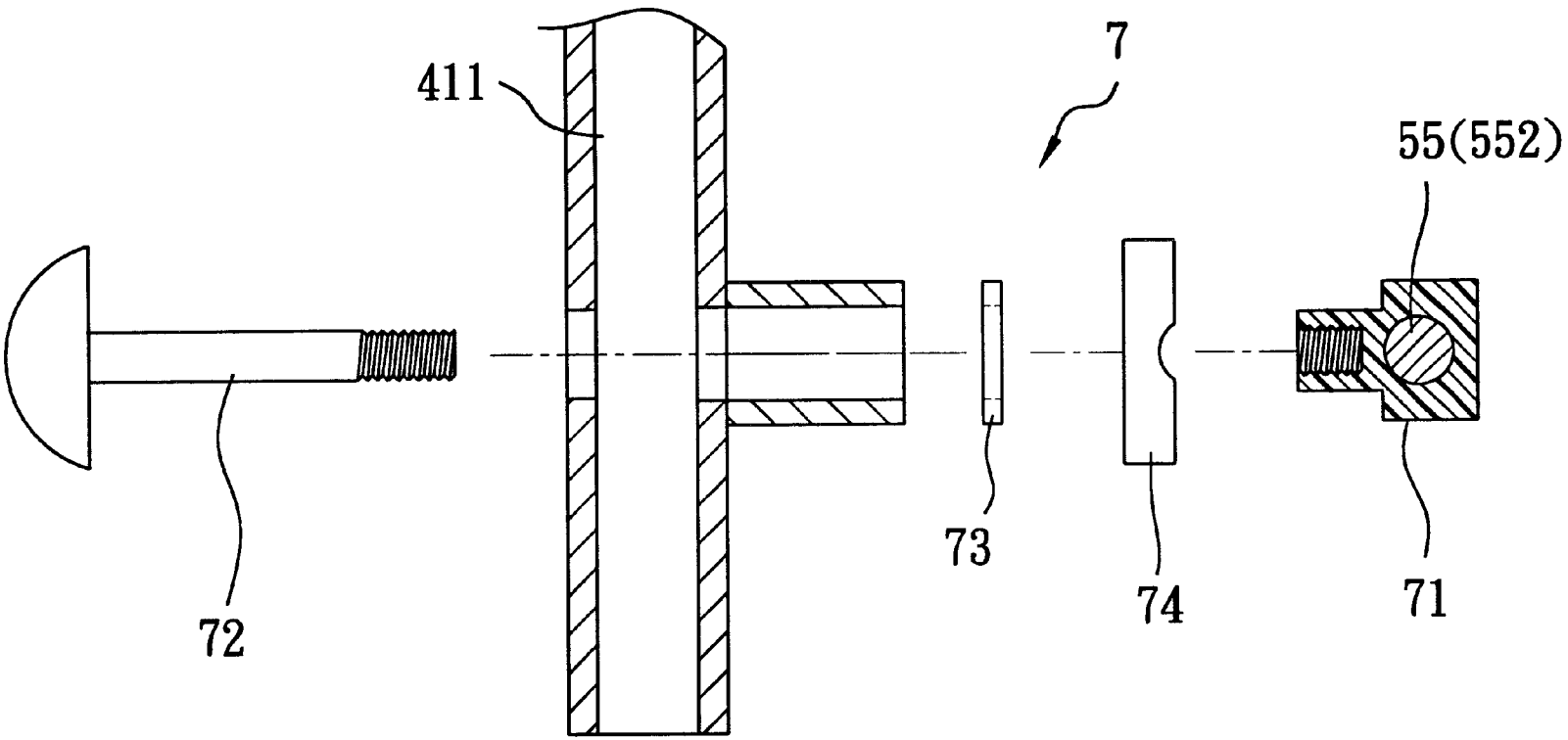
FIG. 7 is a fragmentary and partly exploded sectional view of a supporting member for supporting the seat frame on the armrest frames of the seat units shown in FIG. 4.
Figure 8B:
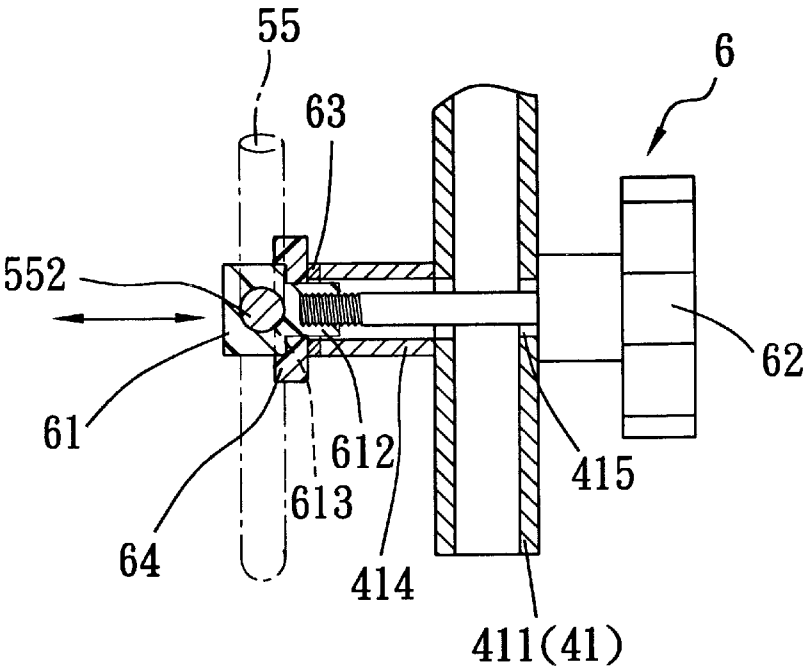
FIGS. 8(A) and 8(B) respectively show how the locking unit and the supporting member of FIGS. 6 and 7 cooperatively support the seat frame on the armrest frames of the seat units shown in FIG. 4.
Figure 8A:
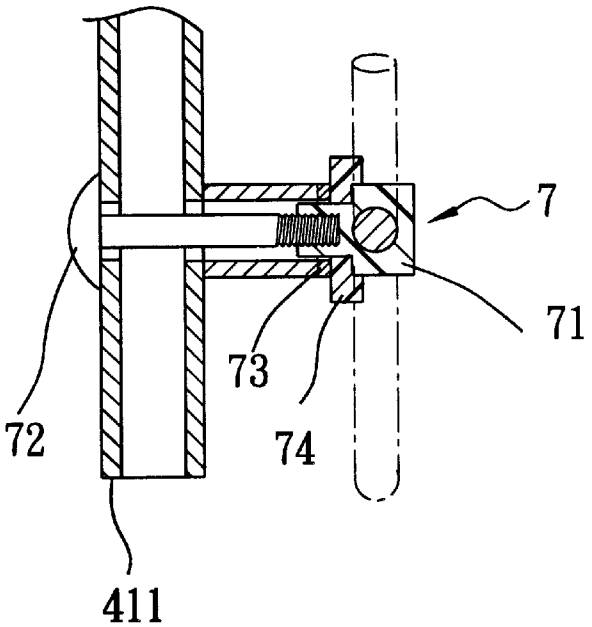

Referring to FIG. 7, the supporting member 7 includes an inner sleeve 71 and an inner screw rod 72. The inner sleeve 71 is sleeved slidably on the engaging rod section 552 of the inner rod member 55. The inner screw rod 72 is mounted rotatably on the inner front leg 411, and threadedly engages the inner sleeve 71 through a washer 73 and a clamping plate 74 (see FIG. 8 (A)), thereby supporting one side of the seat frame 51 on the inner front leg 411.

Figure 6:
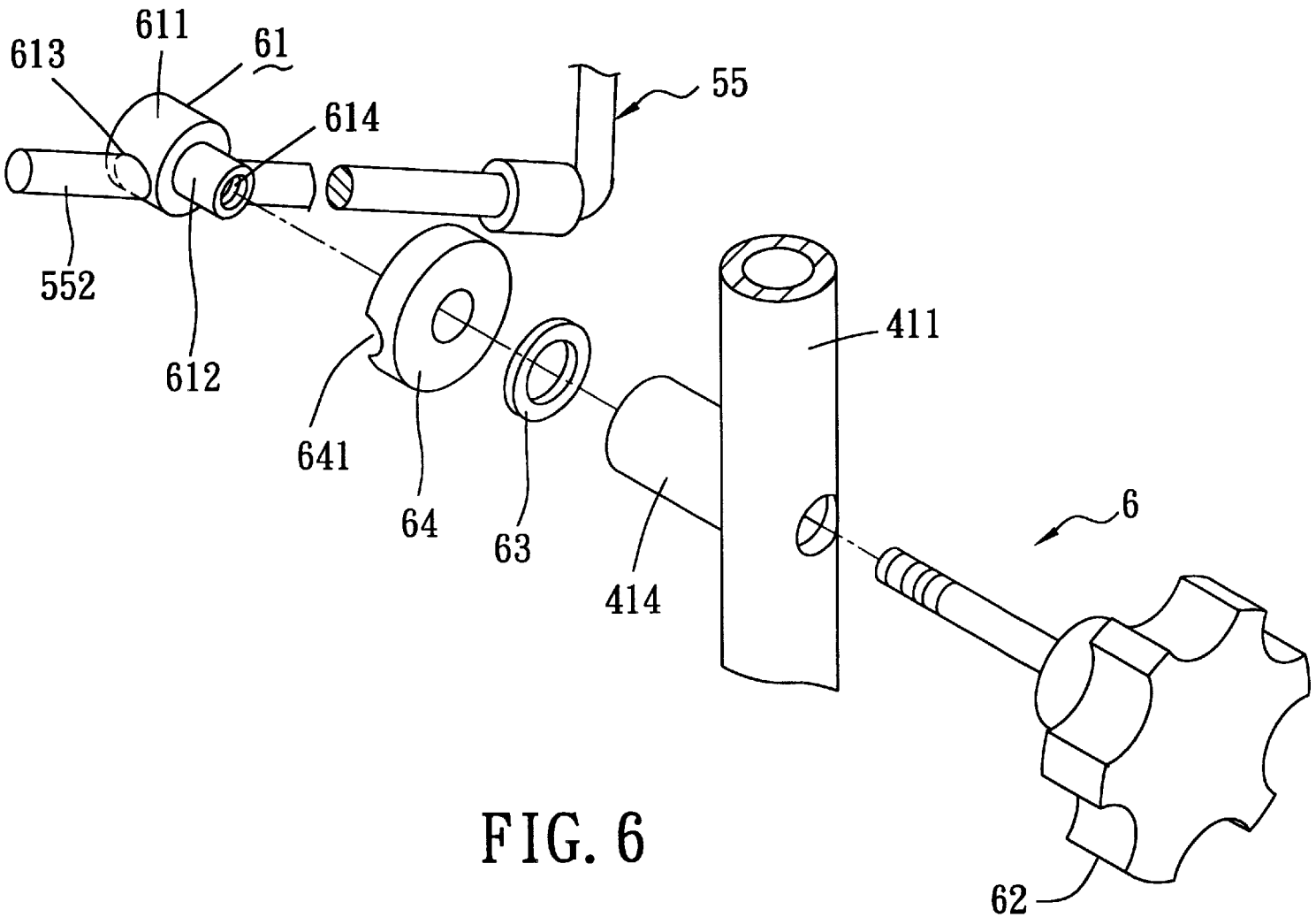
FIG. 6 is a fragmentary and partly exploded perspective view of a locking unit for locking a seat frame relative to two armrest frames of the seat units shown in FIG. 4.

Referring to FIG. 6, the locking unit 6 includes an outer sleeve 61, an abutting plate 64 and an outer screw rod 62. The outer sleeve 61 is sleeved slidably on the engaging rod section 552 of the outer rod member 55. The abutting plate 64 is disposed between the outer front leg 411 and the outer sleeve 61. The outer screw rod 62 is mounted rotatably on the outer front leg 411, and threadedly engages the outer sleeve 61 in such a manner that tightening of the outer screw rod 62 results in engagement between the abutting plate 64 and the engaging rod section 552 of the outer rod member 55 (see FIG. 8(B)), thereby preventing sliding movement of the engaging rod section 552 of the outer rod member 55 relative to the outer sleeve 61, which, in turn, prevents movement of the seat frame 51 together with the backrest frame 52 relative to the inner and outer armrest frames 41, and that loosening of the outer screw rod 62 results in disengagement between the abutting plate 64 and the engaging rod section 552 of the outer rod member 55, thereby permitting sliding movement of the engaging rod section 552 of the outer rod member 55 relative to the outer sleeve 61, which, in turn, permits movement of the seat frame 51 together with the backrest frame 52 relative to the inner and outer armrest frames 41.

The support frame 32 has opposite top and bottom ends 321, 322, and left and right suspending members to 31. The left and right suspending members 31 have upper ends connected swingably to the top end 321 of the support frame 32, and lower ends connected swingably and respectively to two armrest portions 413 of the outer armrest frames 41 of the seat units 4.

Referring once again to FIG. 6, the outer sleeve 61 preferably includes a first cylindrical portion 611 that defines a rod passage 613 to permit extension of the engaging rod section 552 of the outer rod member 55 therethrough, a second cylindrical portion 612 that is reduced from and that extends coaxially from the first cylindrical portion 611 toward the outer front leg 411 and that is formed with an internal thread 614 which engages the outer screw rod 62. The locking unit 6 further includes a plate-pushing sleeve 414 that is sleeved on the outer screw rod 62, and that is disposed between the abutting plate 64 and the outer front leg 411 for moving the abutting plate 64 to engage the engaging rod section 552 of the outer rod member 55 upon tightening of the outer screw rod 62. A washer 63 is disposed between the plate-pushing sleeve 414 and the abutting plate 64. The abutting plate 64 is preferably formed with an engaging indentation 641 that engages the engaging rod section 552 of the outer rod member 55 upon tightening of the outer screw rod 62.

Preferably, a horizontal support plate 45 is disposed on and cooperates with the inner armrest frames 41 of the seat units 4 (see FIG. 4) to serve as a tea table.

Figure 9:
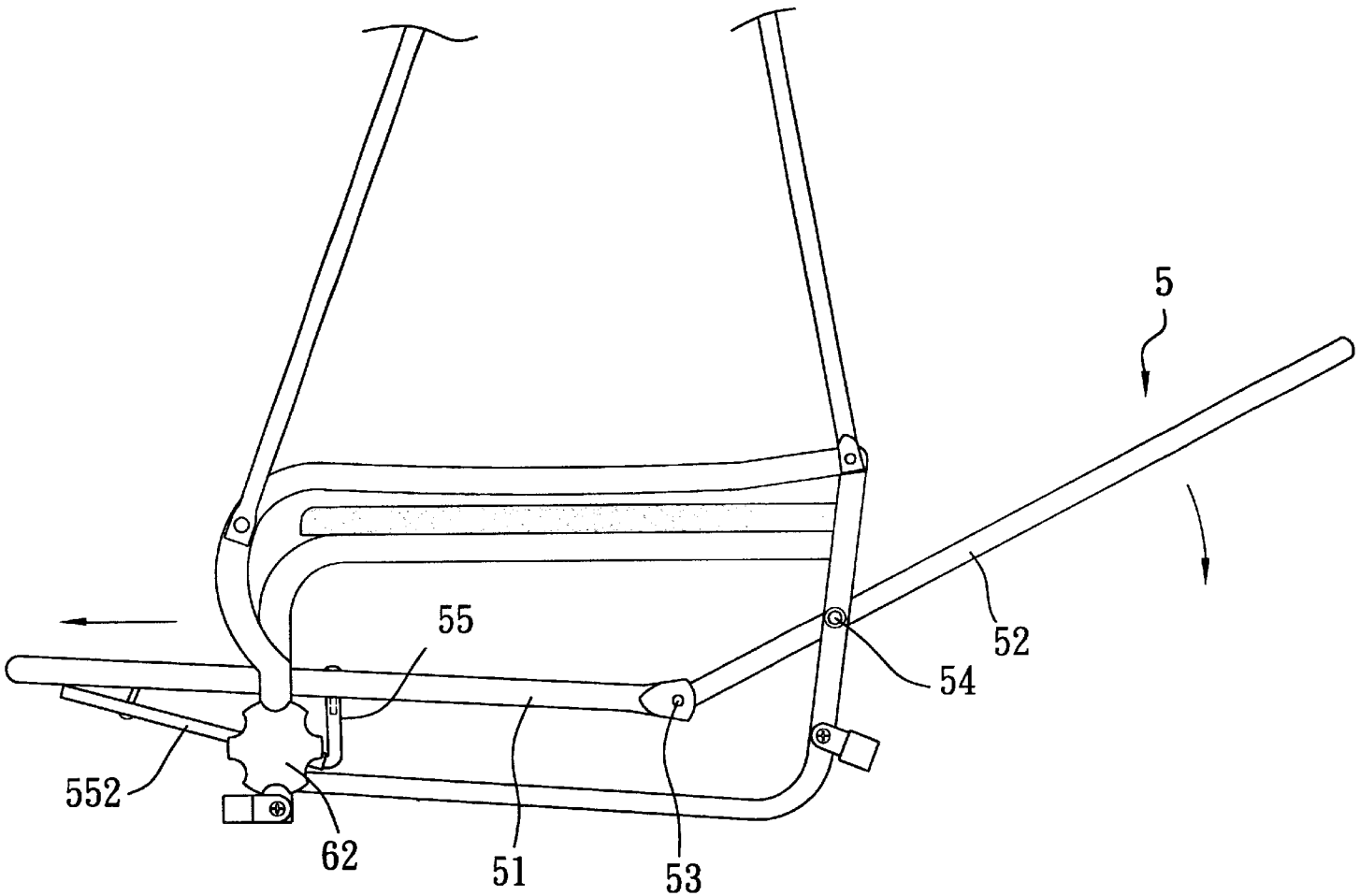
FIG. 9 is a fragmentary side view of the preferred embodiment, illustrating the seat units in a tilted position.

Since loosening of the outer screw rod 62 permits desired inclination adjustment of the seat frame 51 relative to the backrest frame 52 (see FIG. 9) and since the seat units 4 can be disassembled, the aforesaid disadvantages of the prior art are thus overcome.

With this invention thus explained, it is apparent that numerous modifications and variations can be made without departing from the scope and spirit of this invention. It is therefore intended that the invention be limited only as indicated in the appended claims.

I claim:

1. A swing comprising:

a pair of seat units, each of said seat units including a plurality of front brackets, a plurality of rear brackets, front and rear connecting rods, spaced apart inverted U-shaped inner and outer armrest frames having inner and outer front legs connected detachably to said front connecting rod through said front brackets, and inner and outer rear legs connected detachably to said rear connecting rod through said rear brackets, a seat frame disposed between said inner and outer armrest frames, first and second pivots, a backrest frame extending upwardly from and pivoted to said seat frame through said first pivot, said inner and outer rear legs being pivoted to said backrest frame through said second pivot that is parallel to and that is disposed at an elevation above said first pivot so as to permit position adjustment of said backrest frame relative to said seat frame and so as to permit adjustment of said seat frame together with said backrest frame relative to said inner and outer armrest frames, L-shaped inner and outer rod members disposed below and secured to said seat frame, and disposed respectively adjacent to said inner and outer front legs, each of said inner and outer rod members having an engaging rod section, a supporting member including an inner sleeve sleeved slidably on said engaging rod section of said inner rod member, and an inner screw rod mounted rotatably on said inner front leg and threadedly engaging said inner sleeve so as to support one side of said seat frame on said inner front leg, and a locking unit including an outer sleeve sleeved slidably on said engaging rod section of said outer rod member, an abutting plate disposed between said outer front leg and said outer sleeve, and an outer screw rod mounted rotatably on said outer front leg and threadedly engaging said outer sleeve in such a manner that tightening of said outer screw rod results in engagement between said abutting plate and said engaging rod section of said outer rod member, thereby preventing sliding movement of said engaging rod section of said outer rod member relative to said outer sleeve, which, in turn, prevents movement of said seat frame together with said backrest frame relative to said inner and outer armrest frames, and that loosening of said outer screw rod results in disengagement between said abutting plate and said engaging rod section of said outer rod member, thereby permitting sliding movement of said engaging rod section of said outer rod member relative to said outer sleeve, which, in turn, permits movement of said seat frame together with said backrest frame relative to said inner and outer armrest frames; and an upright support frame having opposite top and bottom ends, and left and right suspending members having upper ends connected swingably to said top end of said support frame, and lower ends connected swingably and respectively to said outer armrest frames of said seat units.

2. The swing as defined in claim 1, wherein said outer sleeve includes a first cylindrical portion defining a rod passage to permit extension of said engaging rod section of said outer rod member therethrough, a second cylindrical portion that is reduced and that extends coaxially from said first cylindrical portion toward said outer front leg and that is formed with an internal thread which engages said outer screw rod.

3. The swing as defined in claim 1, further comprising a horizontal support plate that is disposed on and that cooperates with said inner armrest frames to serve as a tea table.

* * * * *